United States Patent [19]

Bull, Jr.

[11] Patent Number: 4,765,512

[45] Date of Patent: Aug. 23, 1988

[54] SELF-DISPENSING SPRING BIASED THIN FILM CONTAINER

[76] Inventor: Glen C. Bull, Jr., R.R. #3, Box 1695, Spotsylvania County, Va. 22553

[21] Appl. No.: 890,607

[22] Filed: Jul. 30, 1986

Related U.S. Application Data

[63] Continuation-in-part of Ser. No. 542,905, Oct. 20, 1983, abandoned, which is a continuation of Ser. No. 41,426, May 22, 1979, abandoned, and a continuation of Ser. No. 875,978, Jun. 19, 1986, abandoned, which is a continuation of Ser. No. 448,973, Dec. 16, 1982, abandoned, which is a continuation-in-part of Ser. No. 41,426, May 22, 1979, abandoned.

[51] Int. Cl.[4] ..... B65D 35/34

[52] U.S. Cl. ..... 222/100; 222/135; 222/107; 222/183; 251/208

[58] Field of Search ..... 222/99, 100, 105, 94, 222/107, 183, 92, 135, 396; 137/625.31; 251/208

[56] References Cited

U.S. PATENT DOCUMENTS

| | | | |
|---|---|---|---|
| 1,731,703 | 10/1929 | Bourke | 222/99 |
| 2,166,307 | 7/1939 | Libby | 222/94 |
| 2,298,884 | 10/1942 | Hope . | |
| 2,802,600 | 8/1957 | Burk | 222/100 |
| 3,134,515 | 5/1964 | Callohan | 222/527 |
| 3,259,276 | 7/1966 | Chase | 222/100 |
| 3,349,965 | 10/1967 | Krugger | 222/183 |
| 3,381,818 | 5/1968 | Cope et al. | 222/107 |
| 3,381,857 | 5/1968 | Francis . | |
| 3,454,197 | 7/1969 | Thompson | 222/183 |
| 3,458,087 | 7/1969 | Cox, Jr. . | |
| 3,647,117 | 3/1972 | Hargest | 222/100 |
| 3,670,926 | 6/1972 | Hill . | |
| 3,949,934 | 4/1976 | Goglio | 222/396 |
| 4,077,543 | 3/1978 | Kulikowski et al. . | |
| 4,098,434 | 7/1978 | Uhlig . | |
| 4,121,737 | 10/1978 | Kain . | |
| 4,136,802 | 1/1979 | Mascia et al. . | |
| 4,271,984 | 6/1981 | Ducro et al. | 222/94 |
| 4,341,328 | 7/1982 | Redick | 222/183 |

FOREIGN PATENT DOCUMENTS

| | | |
|---|---|---|
| 1143346 | 3/1983 | Canada . |
| 1195666 | 10/1985 | Canada . |
| 2131885 | 1/1986 | United Kingdom . |

*Primary Examiner*—H. Grant Skaggs
*Attorney, Agent, or Firm*—Laurence R. Brown; Alfred J. Mangels

[57] ABSTRACT

A special spring construction is particularly adopted for a dispensing system for fluent materials from a plastic or equivalent thin film bag rolled up inside a coiling spiral formed from a strip sheet constant force spring material to squeeze out the bag contents completely and to produce dispensing force during storage periods for bulk quantities. The coil spring strip may be of a metal, plastic, elastomer or fibrous materials and may form a wall of the bag so that the container may be made at very low cost for storage of bulk fluids for dispensing therefrom one serving at a time. Thus, a package array for fluent materials comprises a thin flexible-walled container or bag having a common area with an uncoiled spiral constant force spring strip and positioned to coil up by rolling up a container bag tail inside the coil spring spiral as constants are discharged. The bag is placed in a container confining the fluid bag contents to occupy a position with a height corresponding to that of the constant force coil spring spiral diameter thereby to exert by the spiral a substantially constant force aiding the discharge of the contents over the entire bag capacity. Various embodiments include mixing of separate stored ingredients at the time of dispensing, the unrefrigerated storage of milk for days, the dispensing of multiple carbonated beverage servings without decomposition, and the aseptic storage and dispensing of fluent materials made possible by preventing entry of air into materials stored in bulk when servings are made to dispense portions thereof.

36 Claims, 6 Drawing Sheets

FIG. 4C
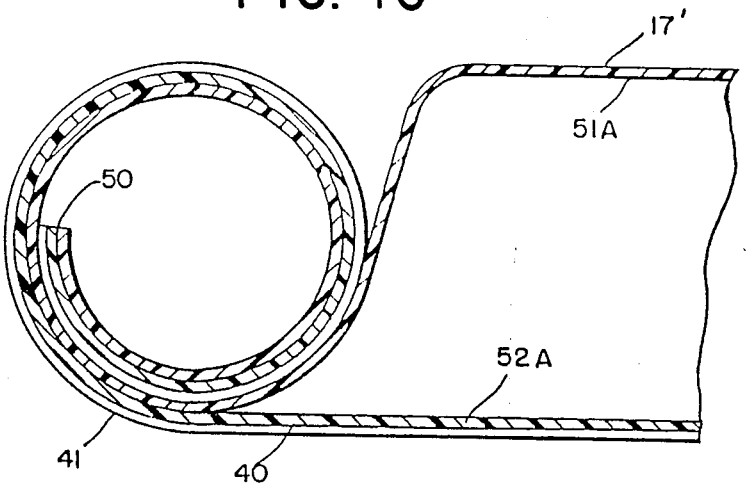
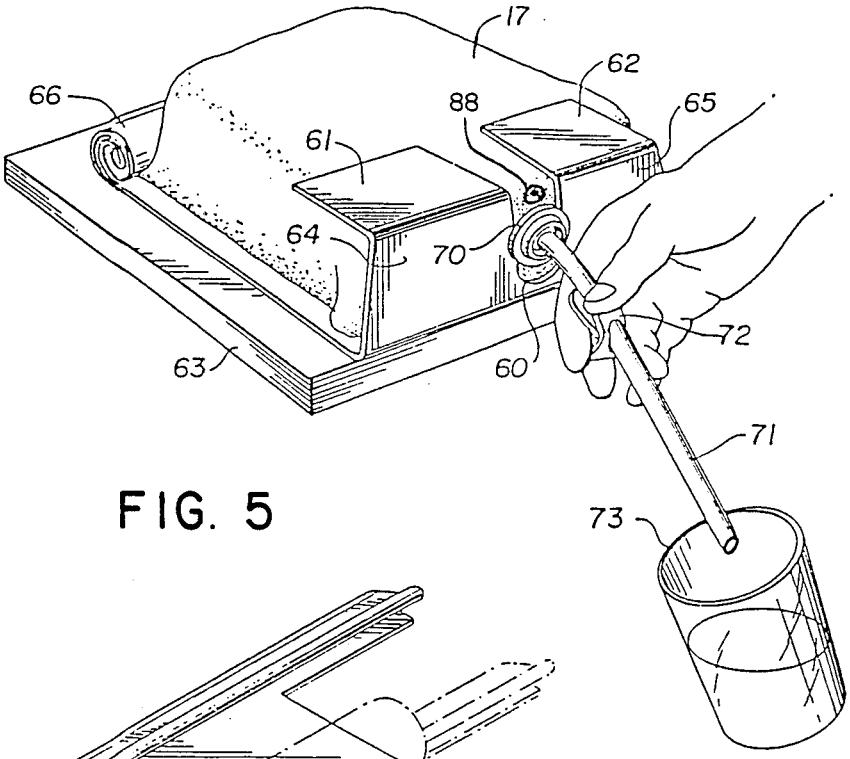
FIG. 5
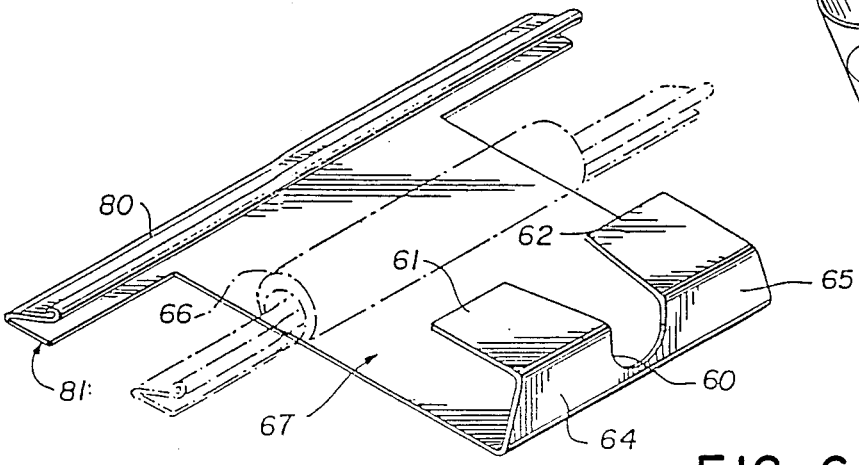
FIG. 6

FIG. 9
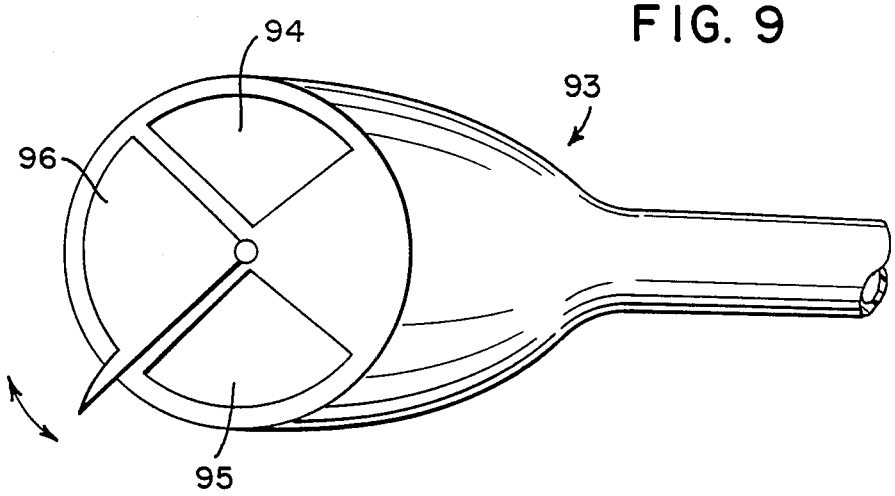
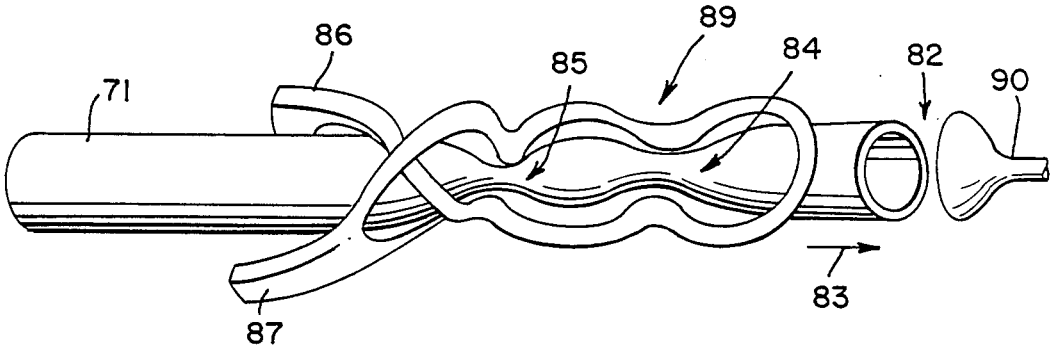
FIG. 8

SELF-DISPENSING SPRING BIASED THIN FILM CONTAINER

This is a continuation-in-part of my two copending applications U.S. Pat. No. 542,905 filed Oct. 20, 1983 (now abandoned), which is a continuation of U.S. Ser. No. 041,426 filed May 22, 1979 (now abandoned), and U.S. Ser. No. 875,978 filed June 19, 1986 (now abandoned), which is a continuation of U.S. Ser. No. 448,973 filed Dec. 16, 1982 (now abandoned), which in turn is a continuation-in-part of U.S. Ser. No. 041,426 filed May 22, 1979 (now abandoned).

TECHNICAL FIELD

This invention relates to the resolution of problems encountered in bulk packaging of fluid and fluent materials under pressure, such as food products, carbonated beverages, and the like in thin film bags for dispensing serving size portions from time to time, and more particularly, it relates to the contamination proofing of stored foods against oxidation, radiation and the like, and the characteristics of storage under pressure magnitudes, fluid flow characteristics, bag features and automated dispensing features relating to particular food product lines.

BACKGROUND ART

Containers for dispensing fluids and beverages such as mustard, catsup, mixed fluids, water, wine, milk or carbonated beverages, in individual serving quantities, such as to fill glasses with beverages often cost more than the contents themselves, such as in the case of beer cans. Furthermore, the containers are difficult to store and present disposal problems. In most cases they have a single resident discharge position for dispensing and cannot be used in both horizontal and vertical positions. There has been no suitable substitute low-cost bulk package for dispensing carbonated beverages, in part, because the carbonation may be lost in storage and upon first opening of the bulk containers.

Also, other forms of bulk packaging, such as the thin plastic film storage bags placed in corrugated cardboard cartons by various packagers for dispensing wine and milk by gravity, are deficient for either commercial or household use to discharge fluids at ideal discharge rates. Furthermore, many bulk packages are tall in aspect ratio and cause storage problems for use in home refrigerators because of the limited storage space therein because of usual shelf dimensions. Not only can it be difficult to completely empty a prior art thin plastic bulk storage bag because of folds, creases and pockets but also the gravity fed package need be tall and full to produce the necessary discharge gravity weight. Thus, contents are wasted and dispensing is inconvenient, particularly since gravity dispensng force varies as contents are used. Loss of expensive liquids such as wine because of incomplete discharge is a problem.

Protection of the sanitation and purity of the contents poses serious problems. After a bulk container is opened, entry of air causes oxidation and bacterial contamination. No prior art bulk packaging is known that simply keeps air out of a bulk storage thin film container from which servings are made from time to time. Also, conventional dispensing methods create conditions such that residual carbonation retained by the beverage is lost when carbonated beverages are attempted to be dispensed from bulk storage by gravity methods.

Contamination in the prior art has not been resolved so that perishables such as milk and orange juice can be bulk stored without refrigeration. With long storage periods, other problems are posed, such as the tendency for separable constituents to settle or dissociate during storage, such as solids in orange juice. The same problems may occur in storage of paint and other fluids which have mixed ingredients.

Accordingly, it is an objective of this invention to provide improved, bulk, low-cost dispensing means and methods employing thin film flexible bags for correcting the foregoing and other prior art deficiences, including variable dispensing pressure, separation of ingredients, decarbonation, contamination and inconvenient aspect ratios.

Some attempts have been made to provide bulk dispensing containers with pressurized discharge by a collapsing elastic member providing discharge force for a bag-like container, or the like, as typified by U.S. Pat. Nos. 4,077,543—D. F. Kulikowski et al., Mar. 7, 1978; No. 4,121,737—C. L. Kain, Oct. 24, 1978; and No. 4,098,434—A. R. Uhlig, July 4, 1978. However, these collapsible elastic members provide varying pressure during discharge and need be packaged in expensive outer containers. Neither do these devices adapt themselves to large bulk amounts of stored materials, such as five or ten liters.

In order to get a more constant dispensing pressure over a large distance, coiled spiral constant force springs have been used to produce dispensing force, for example, in U.S. Pat. Nos. 3,381,857—S. Francis, May 7, 1968; No. 3,647,117—T. S. Hargest, Mar. 7, 1972; No. 4,136,802—C. T. Mascia et al., Jan. 30, 1979; and No. 2,298,844—S. N. Hope, Oct. 13, 1942. However, as proposed in the prior art, these springs have not been effectively combined with thin plastic film containers in such a way as to provide effective and inexpensive bulk storage dispensing containers which provide solutions to the various aforesaid problems.

BRIEF DISCLOSURE OF THE INVENTION

Accordingly, this invention provides an improved packaging combination of a thin film plastic bag bulk storage container and a constant force wide strip spring biased to coil up into a spiral, wherein the contents of a filled bag will hold the spring uncoiled and as the bag is emptied the spring automatically rolls up with the bag thereinside to simultaneously squeeze out the contents thoroughly and with substantially constant pressure over the dispensing range of contents while completely eliminating voids, folds and pockets of accumulated air, effervescence gas, or stored materials.

The bag is inexpensive. For some specialized uses it may be formed with special valves, tubes or other features such as by blow molding. Also, the bag and spring may be self-contained with the constant force spring as a constituent wall of the bag. For some uses, the spring is contained in an outer carton of proper aspect ratio to fit on a home refrigerator shelf to dispense several liters of water, orange juice, carbonated beverage, milk, wine, or the like, from a simple rectangular, edge sealed bulk storage film bag and thus provide low container cost, simple efficient storage and ready access for dispensing.

The dispensing system of this invention has a general combination of a bulk storage container bag holding a plurality of individual servings to be dispensed from time to time, valve and outlet means for discharging the contents of the bag, pressure inducing means for bearing externally on the bag to apply substantially constant discharge pressure on the bag contents over the entire discharge and storage time to permit storage and discharge of the entire contents without entry of air into the bag before or after dispensing begins, and specialized features overcoming the aforesaid and further dispensing problems of special fluent materials, foods and beverages. It affords, in some embodiments, such features as (1) greater strength under pressure and reliability from thinner bags, (2) maintenance of purity of the stored materials without contamination, (3) the ability to store perishable foods without refrigeration, (4) the ability to prevent decarbonation of beverages after the serving container is opened, (5) the ability to uniformly serve over the entire storage period liquid mixtures that tend to separate, (6) the ability to mix in variable portions two or more ingredients at the time of serving, (7) protection of contents from radiation, oxygen and other deteriorating external forces, and (8) specialty handling of fluids of various viscosities.

BRIEF DESCRIPTION OF THE DRAWINGS

Further features, objects and advantages of the invention will be found throughout the following description with reference to the accompanying drawings, wherein:

FIGS. 4A to 4C are various structural embodiments of the spring-thin film bag construction as afforded by the teachings of this invention;

FIG. 5 is a perspective view of a beverage dispensing system embodiment of the invention;

FIG. 6 is a perspective view of a subassembly embodiment of the pressure inducing means external to the bag of the dispensing system afforded by this invention;

FIG. 8 is a sketch of a valve subassembly embodiment for prevention of contamination by exposure of the stored contents to air;

FIG. 9 is a sketch of a simplified mixing valve subassembly embodiment for variably dispensing a range of stored fluids that tend to settle over long storage periods;

DETAILED DESCRIPTION OF A PREFERRED EMBODIMENT

Figure 1:
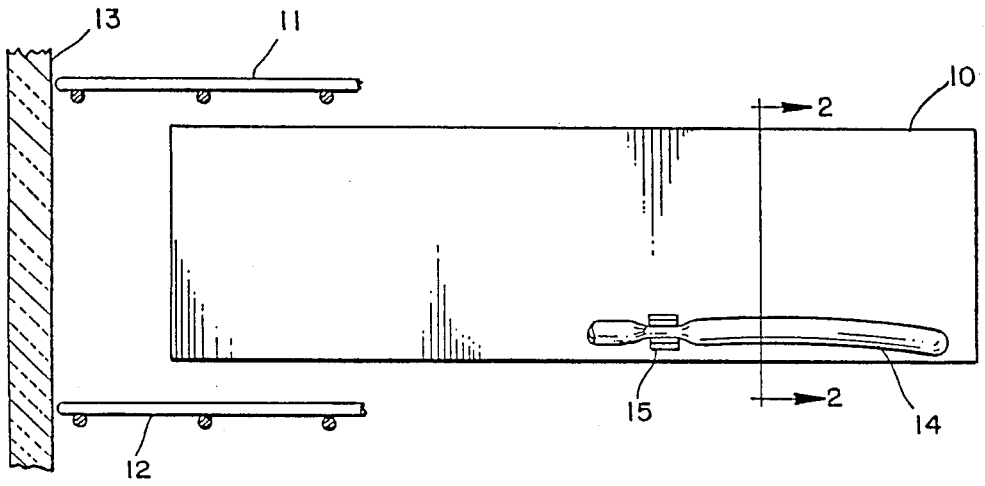
FIG. 1 is a broken away view of a refrigerator shelf looking into the front view of a dispensing container system embodiment afforded by this invention.

In storage of fluent food products of various viscosities and characteristics, such as water, milk, orange juice, carbonated beverages, wine, mustard, etc. it is desirable to provide packages with specialized features. For example, beverages with this invention can be packaged in a carton functionally interrelated with storage and dispensing action having an aspect ratio compatible with standard home refrigerator shelving, as depicted in FIG. 1 by carton 10 between shelves 11 and 12 adjacent refrigerator insulated wall 13. The contents may be discharged by way of flexible hose 14, which may be simply clamped in the clip 15, which serves as a simple valve. A container within the carton 10, typically with cardboard corrugations 16, is a flexible walled thin film bag 17 of plastic or an equivalent flexible thin wall material, as shown in this case partly full of a fluent material 18 to be dispensed. In accordance with this invention a coil spring 22 engages the tail end 19 of the container bag 17, which is preferably an unfilled rectangular shape with advantages later discussed. Thus the bag portion 19 opposite the discharge hose 14, which is typically a ⅜" diameter rubber or plastic flexible tubing, is neatly rolled up within the one layer spiral sheet strip spring 20 as it coils up to maintain a constant external spring pressure upon the contents 18 stored in bag 21 for maintaining content purity and for urging them out the discharge opening at hose 14 throughout various dispensing cycles from time to time until bag 17 is completely emptied. The spring is coiled in its rightmost position against front wall 21 of carton 10. As the flexible bag simultaneously rolls inside the strip spring coil 22 convolutions, all remaining liquid in the tail section 19 is squeezed out into the residual reservoir portion of liquid 18 without any loss of liquid. There is no accumulation of gas pockets in the case of carbonated beverages and thus for the first time an inexpensive bulk storage device is afforded that holds the carbonized contents under pressure as multiple servings are dispensed after the container is first opened for serving.

Note that the spring is a single sheet that coils up about its unsupported inner end and requires no drum or guide. To reduce package cost and simplify operation and reliability it is important to have as few parts as possible.

Figure 10:
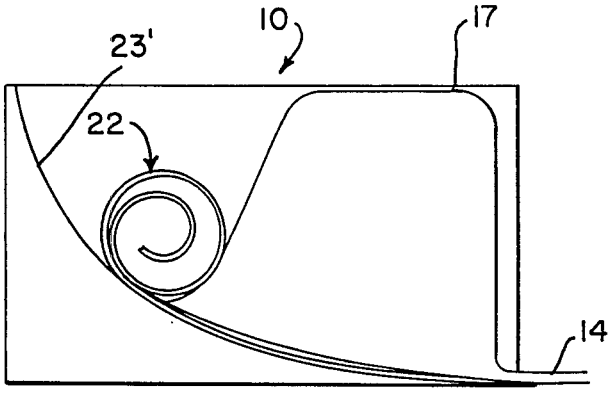
FIG. 10 is a side cut away sketch of a container embodiment with a curved surface providing a path along which the coiled spring follows.

Design data for constant force metal spiral springs is shown in a pamphlet from AMETEK, Hunter Spring Division, Hatfield, PA 19440. These springs can have various widths and forces. Also, plastic springs are available. Preferably for bulk packaging the spring sheets exceed five inches in width for reasons made more explicit hereinafter. Constant force of the coil 22 is maintained upon the stored liquid material 18 tending to hold the effervescent carbonized state intact during long periods of storage, as contrasted with $CO_2$ loss into gas pockets when any pockets or portions of the bag are depressurized such as if the contents were fed out solely by force of gravity. However, supplemental gravity force of discharge may be incorporated and amplified by means of the inserted wedge 23 which gives an inclined surface toward spout hose 14 when the carton is on a refrigerator shelf as shown in FIG. 1. As shown in FIG. 10 the surface which supports the bag 17 and upon which coil spring 22 coils and uncoils is curved. It is clearly shown therefore that the sheet coiled spring 22 affords many advantages in solely providing discharge force or in supplementing gravity force of such items as industrial bulk milk dispensers used in restaurants.

Figure 3:
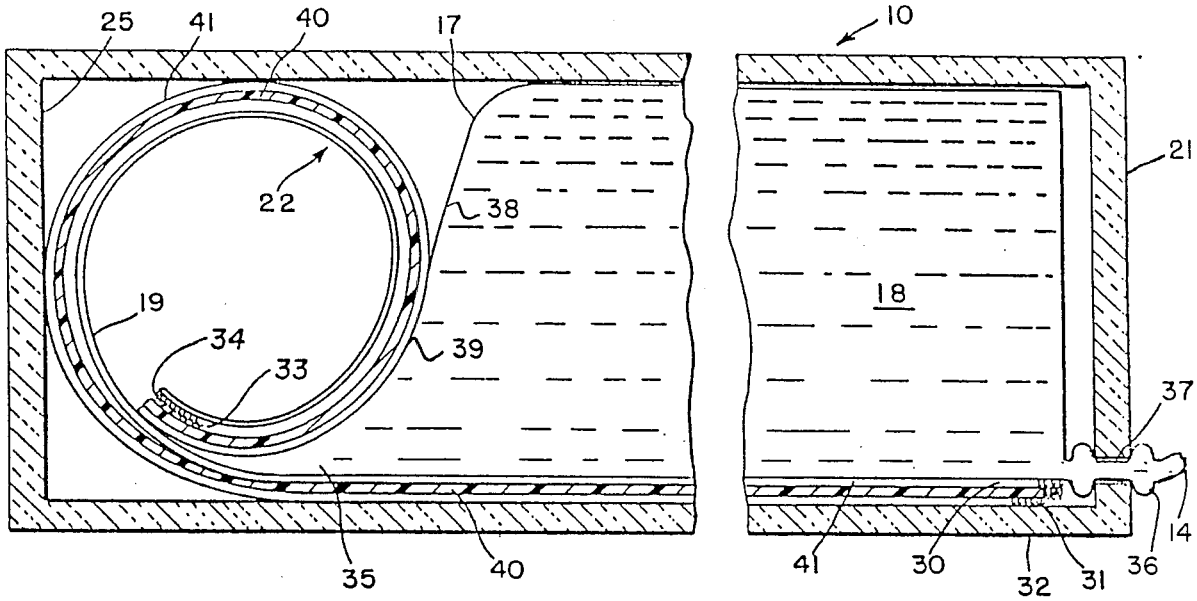
FIG. 3 is a further side view embodiment enlarged in section with the dispensing container filled, showing further features of the invention.

When the container bag 17 is filled as in FIG. 3, the coil 22 is positioned against the rear wall 25 of the carton 10 to have the materials 18 filling the bag 17 and exerting a counterforce toward rear wall 25 tending to unwind coil 22. Thus, the bag 17 may be preloaded and placed in carton 10 to engage a manually uncoiled spring or the materials may be entered into hose 14 orifice at a pressure sufficient to unwind coil 22 when the container bag is emptied, in order to refill it. Carton 10 has sufficient strength to support and limit the filled bag 17 dimensions. In particular, the carton serves as means for retaining the bag adjacent to the uncoiled spring sheet, as means for retaining the bag against a front wall stop and as means engaging the bag with the closed top to limit the uppermost position of the bag wall when pressure is exerted by the spring force. On the other hand the carton-container assembly is inexpensive and can be a single use cardboard item thrown away after use. As such it can be crushed for trash disposal in a compactor or manually to take little disposal space.

The preferable materials for the container bag 17 prevent external oxygen and radiation penetration into the fluent contents and prevent internal liquid under pressure from escaping. Typical are polyethylene and polyester (polyterepthalic acid), commonly referred to as PET, being the preferred bag material for either a separate blow molded bag or sheet bag laminate of two layers or one layer and spring sheet substrate. The preferable bag shape is rectangular and such bags sealed at edges are well known. Sealing of laminated bags is conventional by dielectric, ultrasonic or cement sealing techniques. Methyl ethyl ketone can be used as a liquid adhesive and is manufactured by E. I. du Pont de Nemours & Co., Wilmington, Del. 19898. For moisture and chemical barrier purposes polypropylene is a preferred film material. Thus a polyvinyl alcohol film can serve as a gas barrier. An outer ply of metallized polyester provides excellent oxygen barrier protection. For aseptic packaging aluminum enhanced barrier layers are available. These are particularly important in keeping light away from milk or beer, for example, where light damages content integrity and purity. It is particularly important to keep low intensity radiation out of packaged food. This is around in forms such as Radon, and occurs from fallout. For this purpose layers of boron, tin, copper or lead foil or combinations as coatings over plastic keep out such contamination. This is important for long term storage and is particularly important for protecting food in fallout regions.

In accordance with this invention, wherein the bag 17 and coil spring 22 are rolled up together, it is desirable to hold the outer end 30 of the flat spring strip in place on the container spring mounting surface. This may be done for easy manual removal and insertion when the spring forces are compatible by either a permanent connection, such as riveting or gluing, or by a disconnectable connection, such as a suitable snap fastener operable in the same manner as the fabric to "Velcro" interface depicted by the micro-hook structure 31. The sheet spring end 30 is attached to the floor 32 of carton 10 near the front panel 21 or other planar surface for mounting the spring and retaining the bag. This then lets the coil 22 wind up toward front face 21 of the supporting surface or floor of carton 10. Adhesives, bolts or clamps may also be used to perform this function.

As the coil 22 winds up, the sheet spring across its width of typically 5 to 9 inches grasps a significant area of the preferably rectangular flat tail end portion of the bag 17 to assure a firm grasp without slipping. Then when the contents are engaged by the coils, as at the surface 39, the coil squeezes out the materials at gap 35 to avoid any loss of material while maintaining the optimum spring force pressure of the coil 22 against the bag 17 and contents 18 to urge discharge from spout 14.

Note on the surface 39, a large area of the spring sheet is in contact with a large area of the rectangular bag wall 38 to exert the constant pressure force against the bag contents. Because of this large contact area and the large sidewall area per unit of contents (much larger than if the container were cylindrical in shape) thinner container walls may be used to encouter higher internal forces per square inch. Both the spring force and the internal pressure of the fluent contents are used in design to limit the bag wall design. It is to be recognized that this feature permits the use of less expensive bags and packaging when the thickness of the bag walls will support a maximum pressure closely approaching the force characteristics of the spring.

In the case of carbonated beverages stored at 40° F. a pressure of at least 20 psi (140 kPa) is usually sufficient to prevent loss of $CO_2$ in gas pockets.

This invention is particularly advantageous to store and dispense beverages, such as milk and carbonated beverages, because the coil pressure and outlet discharge means produce dispensing without entry of air, and because in the stored state the beverage is always under pressure. Thus, the spring force acts to pressurize carbonated beverages to maintain an equilibrium pressure at predetermined temperatures (lower pressure for lower temperatures) to keep the beverage from decomposing to set free carbon dioxide that makes the beverage flat. That plus the feature preventing entry of air when dispensing provides the first use of a simple low cost plastic bulk container for storing over long times and serving portions thereof of carbonated beverages from time to time while the beverages are neither oxidized from entry of air or decarbonated from loss of pressure, as in conventional bottles after being uncapped.

As a matter of fact, for protecting the integrity of foods, such as sterile milk which can be dispensed over long time periods without refrigeration, this dispensing system offers material advantages in dispensing products at preferable flow rates continuously and preventing contamination by air during separated dispensing cycles for individual servings. Gravity flow systems require entry of air into a bulk container, as do conventional bottles and cans that need to be opened to the atmosphere. This dispensing system is airless, and the spring force and outlet opening size, typically ⅜ inch tubing, provide ideal outlet flow characteristics for beverages at the rate of one to two ounces per second to fill glasses, etc. (FIG. 5).

Also as seen in FIG. 3, the arrangement of spout 14 and weight of materials 18 in container bag 17 will tend to keep spring strip end 30 in place, particularly with an enlarged grommet like holder 36 built into hose 14 and spaced outwardly from the bag end wall that is adjacent carton front face 21, to abut front face 21, the spout extending outwardly beyond a carton aperture 37 to hold the bag 17 at the bottom of front panel 21. This bag has an integral hose assembly. Other outlet openings may be used, as later discussed.

A coil spring assembly of a low-cost plastic or fibrous laminated construction of the nature that can be used is shown, for example, in U.S. Pat. No. 2,826,523 to H. Blaszkowski et al., Mar. 11, 1958. Thus, the spring strip has two contiguous layers one 40 cross sectioned for plastic such as a polyester, and the other 41 not cross sectioned to present a variety of base material laminates serving with layer 40 to provide a spring coiling bias of the nature required to dispense the materials.

The spring force and width is selected to provide the desired dispensing pressure and to conform with the packaging dimensions. The wider the spring is the greater the advantage of the laterally distributed spring forces to obtain maximum pressures. These forces are distributed evenly across a wide area of the container surface. It is noted that the strip spring used in this invention has primary utility when the packaging aspect ratio desired is a deep but low profile and particularly cooperates with rectangular shaped bags. Thus, the depth of a box along the length of the coiling strip is considerable and the maximum outer diameter of the coiled spring can be small so that the height need not be great. The spring is preferably unsupported except by connection to the bag retention surface means 32 at the coil outer end 30, and is designed to roll out on that surface, whether flat or curved, without supporting guides or rollers. As shown in FIG. 1, this container combination is well suited for bulk containers to be stored on refrigerator shelves and dispensed from in that resident position without the necessity of removing it and pouring. The width of the spring strip and thus the container is variable, but may be relatively large for economy in package cost per serving since the spring strip is preferably in the form of a sheet of at least 25 to 50 cm in order to have a single economical package with the packaging cost per serving low. The size and construction of the spring is directly related to the bag size as will be discussed hereinafter.

Figure 4A:
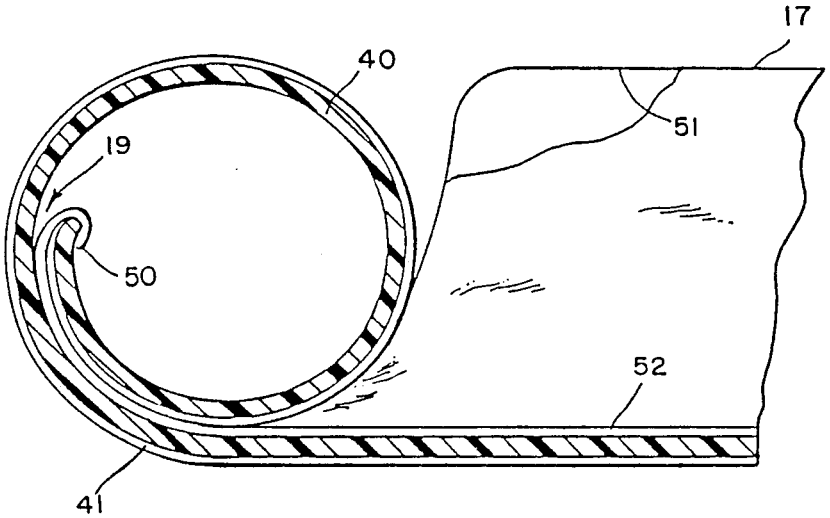
Figure 4B:
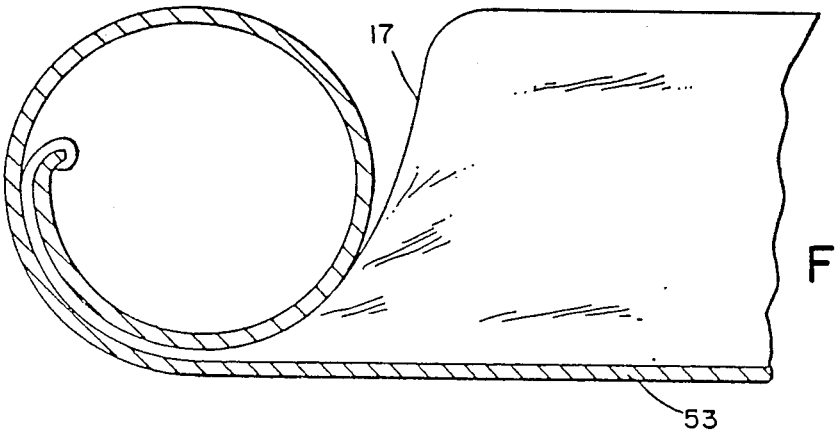

Various construction forms for the dispensing system of this invention are shown in FIGS. 4A to 4C. Thus, in FIG. 4A, the spring strip comprises contiguous layers 40 and 41 of a plastic or fibrous material as for example in U.S. Pat. No. 2,826,523, supra. Thus, the spring structure forms one wall 52 of the bag. It is critical when the constant force spiral spring strip or sheet is used for dispensing bulk materials from a package, that the spring layers 40 and 41 are compatible with the need to expand a thin film bag with considerable volume of contained fluent material so that the bag walls can be rolled up together with the spring to exert the dispensing force of the spring on the materials stored therein. Thus, the two walls 51 and 52 might be of different characteristics if wall 52 is bonded to the spring layer 41. The two layer spring as in FIG. 4A has the layers 40, 41 bonded together over their entire surface. At the spring inner end 50 the tail end 19 of bag 17 is affixed or frictionally held within the spiral coil layers. The bag 17 is not cross hatched, but is shown simply by lines to indicate its thin film quality, and has upper and lower layers 51, 52. This is the configuration as illustrated in FIGS. 2 and 3.

As seen from FIG. 4B, the coil spring strip 53 may be metallic. This is preferable generally only when optimum forces are required or when reusable cartons are provided for refilling or replacing container bags 17.

The version of FIG. 4C is the least expensive unit having the layer 40 of the coil spring strip as a plastic spring comprising the lower layer 52A of the bag 17'. Thus, the upper layer 51A comprises a further plastic film attached or sealed about the junction 50 and edges (not shown) to form a unitary bag-spring assembly. The plastic film may be replaced by an equivalent, such as a thin flexible aluminum film, for example, in some applications.

Figure 2:
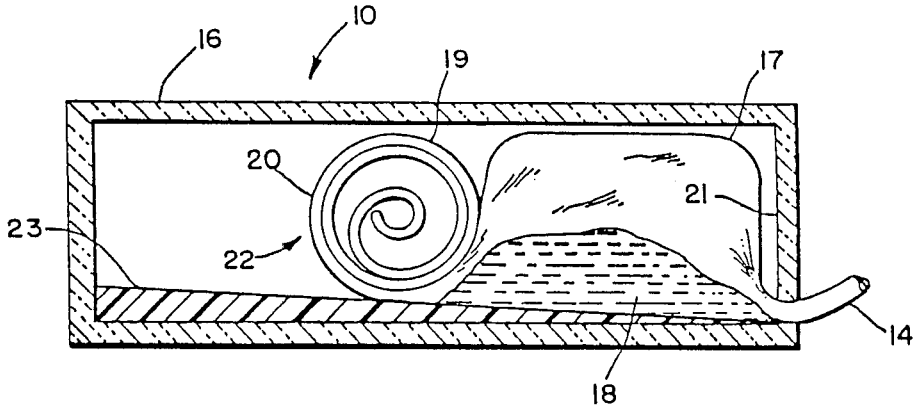
FIG. 2 is a side view in section of a carton containing a partly empty dispensing container as seen from lines 2—2 of FIG. 1.

It is important that the upper bag layer 17' is not coextensive with the constant force spring area but is expandable, otherwise the required container storage capacity shown in FIGS. 2 and 3 would not be available. Thus the two spring layers, if there are two, are bonded together over their entire surface area, and a bag is attached to the spring external to the two bonded layers. Also, it is critical that the layer 17' be wound up into the coil over the entire strip or sheet of the spring layer. It is conceivable that some of the surface area of the coil spring strip or sheet may be deleted as hereinafter discussed.

For many applications the packages used in the beverage dispensing methods afforded by this invention may be simplified and need not have an outer container box. Such embodiments are shown in FIGS. 5 and 6. A coiled spring, preferably of the constant force type, used by this invention, can be constructed in a single piece with bag retention means for disposing the bag cooperatively adjacent the spring member to permit the inner end of the spring to coil and uncoil with the bag wall held in place along a planar surface. A container receiving nest or stop is formed at a position permitting substantially the entire bag wall to be coiled up within the spring member coil, thereby to discharge its entire fluid contents. Here the nest is part of the spring portion about the spout or cap receiving slot 60, and the forward upper surface of bag 17 is restrained by confining wings 61, 62 formed at a front dispensing or outlet end of the bag. Wings 61 and 62 define a slot therebetween that connects with slot 60 for permitting assembly of the outlet member with slot 60. Of course, where a mounting board 63 is used as in FIG. 5, the front stop panels 64, 65 and wings 61, 62 can be separate from the coil spring portion 66. The coil spring can be designed to roll out over a flat surface 67 when uncoiled, as depicted by FIG. 6, or alternatively over a curved surface as in FIG. 10.

As seen in FIG. 5, the bag 17 at least partly filled with fluent material is seated between the coils 66 of the spring, which is winding up therebetween the ends of the plastic film bag walls, and the stop forming a nest to receive the bag dispensing end near its outlet.

Cap structure 70 includes an enlarged, outwardly extending ring or grommet means, similar to enlarged holder 36 shown in FIG. 3, that is spaced outwardly of the end wall of the bag that abuts front stop panels 64 and 65, and that also extends laterally outwardly beyond the edges of slot 60 when the bag is in dispensing position on mounting board 63 as shown in FIG. 5, and thus retains the end of the bag in position against front stop panels 64 and 65 and permits substantially the entire bag to be coiled up within the spring member 66. The spring 66 coils up about its unsupported end and is restrained solely by counter pressure of the fluent material within the bag 17 bearing against the spring coil until the bag is emptied and the spring engages the stop structure at the outlet end of the bag 17.

The portion of the bag 17 retaining fluid is retained on the planar surface of the uncoiled spring portion as supported in this embodiment by the flat surfaced planar mounting board 63. The substantially rectangular shape of the bag provides for a maximized bulk volume and an optimized force relationship to permit heavy bulk loads and greater spring pressure of thinner walled bags. For example, in cylindrical walled containers the fluid weight and pressure is exerted on far less container wall area. Thus, the spring coil 66 engages the bag wall across its width and along a considerable portion of its length related to the coil diameter which is a function of coil design. This exerts the spring pressure over a large area of the bag wall to distribute the spring forces and enable higher spring pressures to be used on thinner walled containers.

The spring 66 coils grasp the bag wall and permit the spring to coil up automatically in response to opening of the outlet means by way of valve 72, without reducing the spring pressure against the contents. This action permits a measured flow of liquids at proper dispensing rates such as about 1½ to 2 ounces per second through a ⅜ inch diameter tube 71. No air need be entered into the bag 17 to dispense as when conventional dispensing from containers such as bottles occurs. The provision of valves 72 that keep air out of the bag during the dispensing cycle, when a serving glass 73 is filled for example, assures the purity and integrity of stored fluent materials, such as food, milk or carbonated beverages, which should not be subjected to oxygen. This is particularly true for sterile materials. The absence of air prevents deterioration of carbonated beverages, since air pockets within the bag 17 would be compressible and thus reduce the effectiveness of spring 66 forces, which prevent decarbonization within equilibrium limits of temperature and spring pressure. Also, it is possible by assuring with bag walls and this dispensing system that unrefrigerated sterile milk can be stored between dispensing cycles for many days and even longer before opening the outlet member.

Reference to FIG. 8 shows a preferable type of valve 89 operable on a flexible hose 71 that prevents any contamination at the end of hose 71 from air contact at the end of the dispensing cycle from traveling back into the fluids stored in the bag. Other valve structures operating in the same general manner with structure particularly adapted to prevent entry of air contamination over long periods encompassing dispensing of several serving cycles, may be employed, but it is convenient to have a flexible hose 71 for the bag outlet means. One reason is to provide simple tamper proof sealing means requiring rupture of a portion of the sealed bag with sterile contents to define the outlet opening. This is effected by sealing the end of tubing 71 at 90 so that it need be severed as at 82 before dispensing.

The valve structure 89 functions to pinch the tube 71 shut in an air tight manner at two positions, namely downstream (as noted by the flow arrow 83) at region 84 and upstream at region 85. Thus, the clamp spring which surrounds tube 71 has a bias to close tightly the region 84 first when the manual pincher tabs 86, 87 are being released to close the tubing. The region 85 is then closed as the tabs are fully released. This means that any air contact as dispensing is terminated is confined to region 84 and cannot travel upstream past region 85 into the fluid storage bag upstream.

Bags may be formed, such as by blow molding, with the tubing 71 integrally attached. Alternatively, they may have a threaded outlet cap structure 70 upon which a reusable tubing assembly or an equivalent is attached. In this case a screw on, membrane piercing dispensing valve may be used, such as is available from Container Technologies, Inc. in Barrington, Ill. A tamper proof seal diaphragm then would be placed over the outlet member 70 until the bag was mounted in the dispensing system and readied for dispensing.

Particularly for use with carbonated beverages, which if improperly stored at high temperatures could exceed equilibrium conditions and cause bursting pressures for thin walled bags, a pressure safety relief valve 88 is mounted on the bag near the dispensing outlet, as seen in FIG. 5.

Cap structure 70 on the bag can mate into slot 60 of the header stop and can comprise a screw-on type or an integrally formed member. The FIG. 5 embodiment has the plastic dispensing hose 71 leading from cap 70 with manually operable clamp 72 used to dispense a serving into glass 73 from time to time. When the beverage contents of the bag 17 are packaged under pressure or sterilized, the tamper proof seal is preferably provided, which is opened when a cap 70, or the like, is screwed on into place. A convenient form of this seal is formed by closing the end 90 of an integrally formed dispensing hose 71 so that it need be cut off to initially dispense the contents of bag 17 (FIG. 8).

In any event, the cap 70, or alternative dispensing discharge outlet, is air tight for retaining the beverages resident in the bag under pressure by force of the coiled spring 66. As the discharge outlet is opened the pressure of the coiled spring 66 is continuous and as for example in the case of carbonated beverages, the pressure is maintained before, during and after the first serving is dispensed. This prevents any entry of air, bacteria or contamination into the container to disturb the integrity of sterile milk, etc.

This simple low cost technique provides the lowest possible bulk container cost—thin film—, and a low cost reusable spring assembly 66, etc., yet affords the significant advantages over the prior art in maintaining internal pressurization while in storage and during dispensing, automatic dispensing without manual pressure on the container, prevention of entry of air and intermittent contaminants during or after dispensing, dispensing of contents without entrapment in container folds or creases, and unrefrigerated storage of aseptic beverages after package opening.

Thus, in accordance with this invention the following steps may be taken and/or realized for improved and economically priced dispensing methods advancing the state of the art:

(a) Packaging a multiplicity of servings of a beverage in a thin-film non-self-supporting flexible walled bulk bag-like container.

(b) Engaging the film of the container bag between layers or coils of a coiled spring member unwound or uncoiled to receive the bag so that the spring is maintained in its uncoiled position by the counterforce supplied by pressure of the beverage contents held in the container bag.

(c) Supplying continuous spring force pressure upon the beverage contents during storage and dispensing for providing dispensing pressure and preventing entry of air or contamination into the bag.

(d) Squeezing, as the spring coil winds up in response to the dispensing of beverages, all the beverage out of the folds and creases in the thin film bag without entrapment of beverages or gases.

(e) Automatically dispensing servings from time to time without manual pressure on the container by selectively opening an air tight discharge outlet in communication with the beverage resident in the bag to thereby permit the spring coil to roll up and displace the beverage.

(f) Closing the air tight discharge outlet to terminate a beverage serving cycle with the spring force applying pressure to the beverage resident in the bag, thereby preventing entry of air or contamination into the container to disturb the integrity of the stored beverage.

(g) Storing aseptic or sterile beverages without refrigeration between servings.

(h) Maintaining carbonation of carbonated beverages resident in the container during storage periods by means of the spring force keeping the beverage under pressure above atmospheric.

(i) Maintaining a sealed discharge outlet on the container bag after filling it with a beverage before a first serving is dispensed therefrom to keep the discharge outlet sterile.

(j) Sterilizing the bag, before filling, with a sterile or aseptic beverage, etc.

The integral spring-nest-clamp assembly of FIGS. 5 and 6 itself is in this embodiment integrally formed on the outer end of the coil spring. The FIG. 6 embodiment provides the further feature of a bag clamping structure 80 being formed integrally on the inner end of the spring for frictionally engaging the bag to be wound up inside the coil. Thus when the spring is unwound the bag 17 end may be inserted into crease 81 and then the coil winds up as shown in phantom view until the spring force and internal beverage pressure equalize. Note that the clamp 80 may be made wider than the sheet spring itself to accommodate a range of different size bags, exceeding the flat spring width.

Note that the wing segments 61, 62 of the spring serve the purpose of the aforementioned enclosing carton top of limiting the upper bag position when the dispensing nears the end of the stored fluids. The slot 60 could be simply an aperture to accommodate an integral hose on the bag if desired.

Various problems are imposed by this dispensing system when handling specific materials. For example, to dispense a higher viscosity material such as mustard with a viscosity of about 15 centipoise, a very heavy spring force is required, along with a larger outlet bag aperture to permit automatic dispensing without manual aid. However, to keep mustard neat and sterile this dispensing system makes an ideal dispenser, for home or industry sizes. A home dispenser could operate with a one inch wide steel spring, for example, and be simply in the form of a spring such as shown in FIG. 6 and a cooperatively interacting plastic mustard bag and outlet valve.

If non-stable food mixtures such as orange juice are to be stored over long periods of time and served from a resident bulk storage unit, settling tends to occur leaving solid residue concentrated at the bottom and watery fluid at the top. Since it is impractical to stir or shake up large bulk quantities and it is desirable to dispense from a resident position on a refrigerator shelf, valve structure such as shown in FIG. 9 may be employed to constitute means for dispensing separated ingredients in the bag from different levels in predetermined proportions.

If this valve-outlet means 93 is considered an attachable screw member affixed at outlet 70 in FIG. 5, the upper and lower openings 94, 95 respectively, will permit mixing watery upper level orange juice (from a horizontally disposed bag with refrigerator shelf aspect ratio) and the thick settled lower level orange juice. Rotatable valve sector 96 then may variably proportion the amount of bag contents taken from different levels in different amounts than the openings accommodate when the sector is in the position shown.

Special bag construction to coact in this dispensing system and with particular foods and food processing conditions are also afforded simply by some of the following techniques.

A coating of radiation resisting medium on the bag film protects against low level radiation.

Special oxygen barrier films prevent seepage of oxygen into the stored contents through the bag walls.

Special barrier films impermeable to fluids and/or gases prevent any change of characteristics or seepage or loss of stored materials through the bag walls.

Special aseptic bag filling techniques, particularly in the case of milk, permit many days of unrefrigerated storage not heretofore possible when bulk storage containers are opened to dispense servings therefrom.

The dispensing system is also particularly adapted for mixing various ingredients at the time of dispensing.

Figure 7:
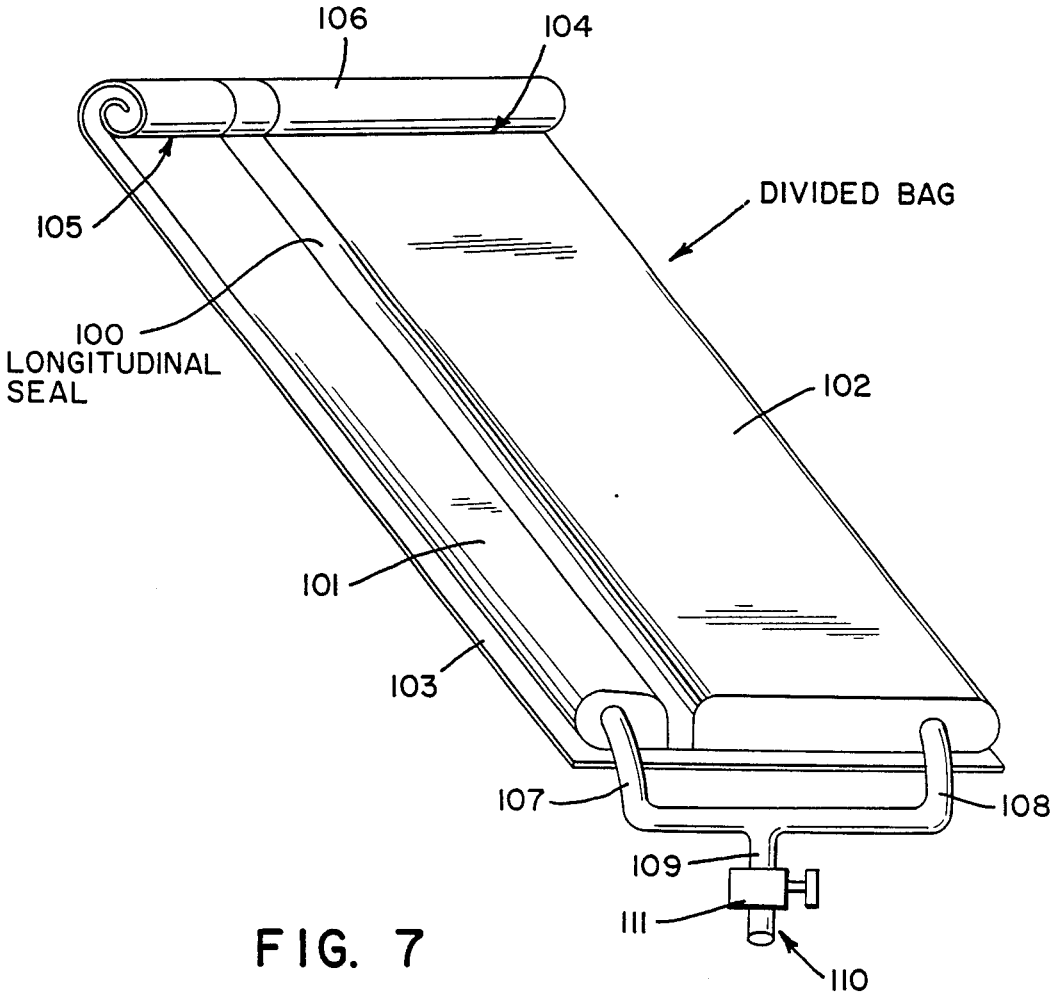
FIG. 7 is a perspective view of a dispensing system embodiment of the invention for separate storage of constituents of a fluid to be mixed when dispensing in a desired proportion.

With reference to FIG. 7, it is seen that the storage bag may be divided longitudinally along seal line 100 to form isolated compartments 101 and 102. The spring 103 operates as aforesaid to roll up both compartments simultaneously about the unsupported inner end thereof, and to exert the pressure at the spring coil—bag interfaces 104, 105 produced by the coils 106 of the spring at its inner end.

The two discharge outlet tubings 107, 108 therefore are merged at a mixing joint 109 into a single outlet tubing 110 controlled by a clamp or other dispensing control valve 111.

The compartmentalized bag structure simply formed at low cost by a longitudinal seam in the bag thus permits dispensing different fluent materials such as fruit pulp and clear fruit juice to be stored separately and mixed when dispensed in individual servings. Two separate bags could also be used as an equivalent.

Other materials such as chemically co-acting ingredients which should not be mixed until dispensing, including epoxy resin constituents, can be dispensed in this way. The proportion of ingredients can be mixed without a special mixing valve into desired proportions by proportioning the width of the bag compartments.

Figure 11:
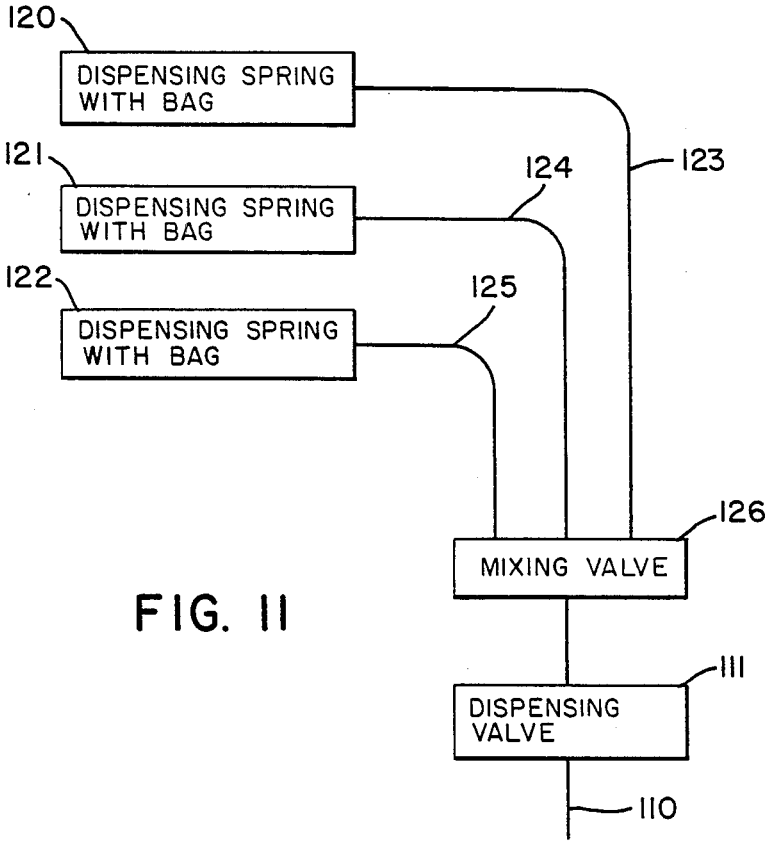
FIG. 11 is a schematic sketch of an assembly of dispensing containers providing an embodiment of the invention for mixing various fluids at the time of dispensing.

The embodiment of FIG. 11 provides for vertical stacking of a plurality of springs in the dispensing system as schematically shown with 120, 121, 122 representing separate bag-spring dispensing systems of the type described, which may be conveniently vertically stacked in a rack. The outlets 123, 124, 125 from the individual bags are coupled together in a variably selectable mixing valve 126.

The separate bags need not be the same size so that the mixing function may be partly a function of bag construction of an individual unit 120, 121 or 122. Also, the mixing valve may control only part of the outlets 123, 124, 125. For example, assume that dispenser 120 discharges directly carbonated water and a choice is given to select a mix such as a cola drink and a citrus fruit based drink from dispensers 121 and 122 to be mixed therewith. Various combinations and selections are possible with this embodiment using a variety of different fluid ingredients, including for example, paints and various tinting colors.

Having therefore advanced the state of the art with improved beverage and fluent material dispensing methods, those features of novelty believed representative of the spirit and nature of the invention are defined with particularity in the claims.

INDUSTRIAL APPLICABILITY

A self-dispensing container incorporating a thin film flexible bag and a sheet strip constant force spiral spring provides a low-cost, readily manufactured bulk container for fluent materials substantially reducing container cost per serving.

I claim:

1. A dispensing system for dispensing fluent material from a bulk storage bag having an outlet member thereon with the capability of dispensing a plurality of servings from time to time over an extended storage period, by use of the force provided by a coiled, constant-force sheet spring that bears against the storage bag to maintain pressure on the bag contents to prevent the entry of air into the bag while simultaneously dispensing the material, comprising in combination, a thin walled, flexible film bag for bulk quantities of a fluent material, the bag being in the general form of a rectangular parallepiped having an inner longitudinal end and having an outer longitudinal end including an outlet member, the outlet member including an enlarged portion spaced from the outer longitudinal end of the film bag, a supporting surface for supporting the bag, a single sheet, constant force spring member having a predetermined force and an unsupported inner end and having an outer end secured to the supporting surface with the sheet biased to coil up around its inner end into a coil of predetermined final diameter from an uncoiled, sheetlike position along the supporting surface and so constructed as to coil up convolutely with the bulk storage bag so that the bag is coiled up between spring coils from the inner end to the outer end thereof as the fluent material is being dispensed, thereby producing a constant force of the spring member against fluent material contained within the bag, bag retention means cooperatively disposed adjacent the inner end of the spring member for gripping and retaining the inner end of the bag, the spring overlying the supporting surface with the outlet member of the bag near the outer end of the spring member and for disposing a coiled portion of the bag about the inner end of the spring to bear against a surface of the bag and therefore the fluent material therein so that the coiled portion of the bag and the spring bear against a surface area of the bag substantially across its width and along a portion of its length, thereby to exert a pressure against fluent material disposed within the bag at all times during storage and dispensing to prevent the entry of air into the bag through the outlet member and permitting coiling up of the bag between spring coils during dispensing in response to opening of the outlet member to permit flow of the fluent material therefrom, bag stop means carried on the supporting surface for retaining the outer end of the bag in place relative to the supporting surface, the bag means including a fixed stop extending substantially perpendicularly from the supporting surface for engaging the outer longitudinal end of the bag in contacting relationship and at a position on the supporting surface for permitting substantially the entire bag to be coiled up toward the bag stop means and within the spring member coils, thereby to discharge its fluent contents through the outlet member, the fixed stop further including a substantially U-shaped opening for slidably receiving and retaining the bag outlet member with the enlarged portion of the outlet member abutting the fixed stop and extending laterally outwardly beyond the U-shaped opening for securely supporting the bag outlet member at a lower portion of the U-shaped opening, and bag engaging means carried by the bag stop means and spaced from the supporting surface, the bag engaging means extending over and contacting at least a part of an uppermost surface of the bag for confining and supporting the outer end of the bag relative to the supporting surface to prevent longitudinal and upward bulging of the outer end of the bag as the inner end of the spring approaches the bag stop means, the bag engaging means including slot means communication with the U-shaped opening in the fixed slot for permitting assembly of the outlet member and enlarged portion to the fixed stop, wherein the spring member when uncoiled is restrained against coiling by a restraining force provided by counter pressure of the fluent material within the bag bearing against the spring member coil.

2. The dispensing system of claim 1, further comprising, a spring member producing a force great enough to dispense from a bag contained therein a fluent material of a viscosity of about fifteen centipoise.

3. The dispensing system of claim 1, further comprising, a spring member producing a force great enough to dispense a water consistency liquid from a bag having a three-eighths inch discharge outlet opening in the outlet member at a flow rate of two ounces per second.

4. The dispensing system of claim 1, further comprising, a spring member providing a force great enough to impart a pressure of at least 20 psi on a liquid contained in a bag retained by and coiled upon the spring coils while its outlet member is closed to prevent the flow of liquid out of the bag.

5. The dispensing system of claim 1, further comprising, a spring sheet of a width of at least five inches.

6. The dispensing system of claim 1, further comprising, a spring sheet of a predetermined width and having at its inner end a wider portion constructed to engage across its width a bag of a width greater than that of the spring sheet.

7. The dispensing system of claim 1, wherein the bag retention means includes structure integrally formed with the spring sheet, including a folded over portion at the spring inner end in which the inner end of the bag is received and retained.

8. The dispensing system of claim 1, wherein the bag retention means includes a bag receiving clamp carried by the inner end of said spring sheet for receiving and grasping the inner end portion of the bag.

9. The dispensing system of claim 1 further comprising a thin film bag having opposite walls of substantially rectangular shape when unfilled, with a portion of one wall of the bag being disposed on said uncoiled portion of the sheet spring member with the other bag wall having a predetermined wall thickness to withstand a predetermined maximum pressure of fluid contents thereon, and the sheet spring member exerting a force over an area of the other bag wall extending across the width and along a portion of the length of the other bag wall, thereby to impose a pressure on the fluent material in the bag closely approaching the predetermined maximum pressure, whereby larger bulk quantities of fluent material may be stored in and dispensed from bags of said predetermined wall thickness than is feasible with containers of cylindrical shapes having greater wall thicknesses than the predetermined wall thickness.

10. The dispensing system of claim 1 further comprising, a thin wall flexible bag having a coating of radiation resisting medium thereon to prevent low level radiation from passing through the bag walls and contaminating the contents of the bag during periods of storage and dispensing.

11. The dispensing system of claim 1 further comprising, a flexible thin walled bag that readily coils up in the spring coils and having walls impermeable to the passage of fluid and oxygen, thereby to permit long time storage and dispensing under pressure of materials by said spring member without penetration of the walls by external oxygen or internal fluent material.

12. The dispensing system of claim 1 further comprising, second bag, each bag being separate and for storing different fluent materials, each bag having an outlet opening and operable to dispense servings of each of the fluent materials when an outlet opening is opened to permit spring force to discharge the contents of the bags through the openings, and output flow control means for mixing the fluent materials that flow from the two bags for providing a single flow stream of mixed fluent materials.

13. The dispensing system of claim 12 further comprising, mixing valve means for selectively mixing different proportions of the fluid materials dispensed from the separate bag compartments.

14. The dispensing system of claim 1 further comprising, an outlet opening in the outlet member, and valve means in the outlet member for closing the outlet member to retain the fluent material in the bag for storage under the pressure imposed by the spring member and for opening the outlet member to discharge the fluent material therethrough in response to the pressure exerted on the fluent material by the spring member.

15. The dispensing system of claim 14 wherein the valve means prevents entry of air into the bag through the opening over long storage periods during which dispensing of several servings of the fluent material takes place.

16. The dispensing system of claim 15 further comprising, an outlet member including a flexible tube, and wherein the valve means includes closing means for closing the tube with an airtight clamping action first at a downstream position of flow of the fluent material from the bag and thereafter at an upstream position.

17. The dispensing system of claim 14, wherein the valve means operates to close the outlet flow path in sequence in two different locations along the flow path.

18. The dispensing system of claim 1 further comprising, said supporting surface being curved to define a curved path along which said spring member coils.

19. The dispensing system of claim 1, wherein one wall of the bag is the sheet spring member.

20. The dispensing system of claim 1 wherein said bag retention means is disposed above the bag and generally surrounds the spring and bag and includes a top limiting member which engages and overlies the bags upper most surface to limit the uppermost position of the bag wall when under.

21. The dispensing system of claim 20, wherein the supporting surface generally encompasses the spring and bag and defines the bag retention means, the bag having an aspect ratio for orienting the bag horizontally between shelves of a home refrigerator, whereby fluent materials may be dispensed while the bag is on a shelf in the refrigerator.

22. The dispensing system of claim 1 further comprising, a sterile fluent material being a perishable food product being disposed in the bag without the presence of air.

23. The dispensing system of claim 22 further comprising, a barrier bag wall structure preventing gases from passing through the bag walls during storage of the fluent material.

24. The dispensing system of claim 22 further comprising, a carbonated beverage disposed in the bag, a spring member producing a force sufficient to maintain said carbonated beverage at equilibrium pressure at a predetermined temperature and to keep the beverage from decarbonating during a storage and dispensing cycle in which a plurality of servings are dispensed at different times.

25. The dispensing system of claim 24 having a relief safety valve for limiting the maximum internal pressure in the bag to a value below the bursting capacity of the bag walls.

26. The dispensing system of claim 22 further comprising, milk disposed in the bag, bag wall structure preventing the intrusion of oxygen into the bag during storage, dispensing valve means defining an opening for dispensing the milk in individual servings without permitting entry of air into the bag for contaminating milk contained therein, whereby the milk may be stored and dispensed without refrigeration to extend the shelf life of the milk.

27. The dispensing system of claim 22 further comprising, food means within the bag and consituting a fluent material having a viscosity of about 15 centipoise, and sheet spring means having a constant force sufficient to discharge the fluent material from an opening in the bag solely by means of the force of such spring means exerted against the bag.

28. The dispensing system of claim 27 further comprising, mustard as said food means, wherein the spring sheet member has a width of about one inch.

29. The dispensing system of claim 1 further comprising, a bag wall structure containing a layer of radiation resistant material to impede penetration of radiation through the bag walls into contact with the fluent material.

30. The dispensing system of claim 1 further comprising, a plurality of said spring members each retaining a separate bag therein with a fluent material held under pressure of the respective spring member for dispensing through an outlet member, and valve means coupled to the plurality of outlet members to mix the fluent materials from at least two of the bags.

31. In a fluid dispenser of the type that rolls up flexible walls of a thin film bag container of a predetermined length having a head end and a tail end and having upper and lower bag surfaces in contact with adjacent coils of a single sheet spring having a head end and a tail end and arranged to extend along the length of the container and in contact with the lower surface thereof to coil up from a tail end of the spring connected to the tail end of the bag and having the coils bearing against the container with enough force to discharge the contents out of a discharge outlet having a selectively openable opening formed in the head end of the bag so that the single sheet spring coils up toward the head end of the spring and bears on the container to establish a continuous discharge pressure on the contents thereof, the improvement comprising, a planar platform, a coilable, generally rectangular sheet spring of predetermined width overlying the platform and having a head end secured to the platform and a tail end spaced therefrom along the platform, a thin film container bag of a predetermined width having its lower surface positioned on the spring between the ends thereof, the container bag including a discharge outlet having an enlarged portion spaced from the head end of the bag, a container stop carried by and extending substantially perpendicularly from the platform at the head end of the sheet spring to form a supporting wall for engaging an end of the bag in contacting relationship and in retaining support across substantially the width of the bag and for receiving and supporting the container discharge outlet, the supporting wall including a substantially U-shaped opening for slidably receiving and retaining the bag discharge outlet with the enlarged portion of the discharge outlet abutting the container stop and extending laterally outwardly beyond the U-shaped opening for securely supporting the bag discharge outlet at a lower portion of the U-shaped opening, and including bag engaging means extending over and contacting at least a part of an uppermost surface of the bag for confining and supporting the head end of the bag relative to the platform and to the supporting wall and to thereby prevent longitudinal and upward movement of the container head end as the spring approaches the supporting wall and to relieve strain on the thin film at the head end of the container as the spring coils bear against the container to supply a discharge pressure on the undispensed contents therein, the bag engaging means including slot means communicating with the U-shaped opening in the container stop for permitting assembly of the discharge outlet and enlarged portion to the container stop.

32. The improvement defined in claim 31 wherein said enlarged portion of said outlet member defines a grommet means of substantially greater pressure bearing capability than said thin film and surrounding the container discharge outlet, the U-shaped opening in said supporting wall serving for receiving thereinto said grommet means in mating and retaining registration and for keeping the container discharge outlet fixed in place relative to the platform without flexing movement when contents are dispensed.

33. The improvement defined in claim 31 including clamping means formed in the tail end of the sheet spring for receiving and grasping the tail end of the thin film bag spaced along the platform from the supporting wall, wherein said clamping means has a width exceeding the width of the sheet spring and extends outwardly from opposite sides thereof to grasp and roll up the tail end of a thin film container having a width less than that of the sheet spring and including a thin film container having a width equal to and exceeding the width of the sheet spring.

34. The improvement defined in claim 31 wherein said container bag is formed of a barrier material that prevents the passage of air therethrough, which is sterile inside and contains bulk quantities for plural dispensing operations of a substantially incompressible sterile fluid food substance that is subject to contamination by contact with air, and said container includes valve means at the head end, the valve means being openable for permitting discharge of the contents by means of the spring force and cleareable to preclude entry of oxygen and other gases into the container and thereby prevent contamination of the contents thereof, whereby the food substance need not be refrigerated to prevent spoilage during storage at ambient temperatures.

35. The improvement defined in claim 34 wherein the container discharge outlet includes a flexible tube defining an outlet discharge pipe terminating in a discharge opening, and having a discharge control valve carried by the flexible tube for preventing discharge of the contents of the container, the discharge control valve including a manually operable clamp positioned on the outlet discharge pipe to close the discharge pipe by pinching the pipe closed while discharge pressure is maintained upon the contents of the bag by the spring to dispense those contents, which clamp prevents air entry into the container bag.

36. In a fluid dispenser of the type that rolls up walls of a thin film container within coils of a single sheet spring member arranged to coil up from a tail end, with the coiled tail end bearing against the container with enough pressure to force the contents out of a discharge outlet having a selectively openable opening so that the spring coils up toward the discharge outlet and bears against the container to establish and maintain pressure on the contents thereof while the contents are being dispensed through the opening, the improvement comprising a planar platform, a coilable, generally rectangular sheet spring overlying the platform and having a head end secured to the platform and a tail end spaced therefrom along the platform, the spring having a width of over 20 cm, a thin film container bag of a width of at least 20 cm positioned on the spring between the ends thereof and having two opposed surfaces disposed along said platform, the container bag including a discharge outlet having an enlarged portion spaced from the head end of the bag, a bag supporting stop member affixed to the platform near the head end of the spring for engaging and holding a head end of the bag in contacting relationship across its width, the stop member including a substantially U-shaped opening for slidably receiving and retaining the bag outlet member with the enlarged portion of the outlet member abutting the stop member and extending laterally outwardly beyond the U-shaped opening for securely supporting the bag outlet member at a lower portion of the U-shaped opening, and including bag engaging means carried by the stop member and spaced from the platform and extending over and contacting at least a part of an uppermost surface of the bag along at least a part of its length in the head end area for confining and supporting the head end of the bag relative to the platform to prevent longitudinal and upward bulging of the head end of the bag as the tail end of the spring approaches the stop member, the bag engaging means including slot means communicating with the U-shaped opening in the stop member for permitting assembly of the discharge outlet and enlarged portion to the stop member, the bag having a tail end held between adjacent coils of the spring, a sterile fluid food product within the bag under pressure from the spring coils during storage when the container discharge outlet is closed and under pressure during discharge from the bag when the container discharge outlet is opened, and discharge valve means connected to the discharge outlet and operable to open the outlet when the spring coil pressure is applied to the contents to prevent the entry of air into the container during dispensing and closing of the valve, said bag having sidewalls of a collapsible material having barrier properties that prevent passage of gases through the sidewalls during storage.

* * * * *